US010767472B2

(12) United States Patent
Pfeiffer et al.

(10) Patent No.: US 10,767,472 B2
(45) Date of Patent: Sep. 8, 2020

(54) SYSTEM AND METHOD FOR CONTROLLED FLOWBACK

(71) Applicant: Schlumberger Technology Corporation, Sugar Land, TX (US)

(72) Inventors: Thomas Pfeiffer, Katy, TX (US); Adriaan Gisolf, Aberdeen (GB); Vladislav Achourov, Tananger (NO); Geir Thomas Glattetre, Kokstad (NO); Kathryn Briggs, Sugar Land, TX (US); Jan Erik Tvedten, Kokstad (NO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/025,191

(22) Filed: Jul. 2, 2018

(65) Prior Publication Data

US 2018/0320515 A1 Nov. 8, 2018

Related U.S. Application Data

(60) Continuation-in-part of application No. 15/843,577, filed on Dec. 15, 2017, now Pat. No. 10,626,721, (Continued)

(51) Int. Cl.
*E21B 49/00* (2006.01)
*E21B 49/08* (2006.01)

(52) U.S. Cl.
CPC ..... *E21B 49/008* (2013.01); *E21B 49/00* (2013.01); *E21B 49/08* (2013.01); *E21B 49/082* (2013.01)

(58) Field of Classification Search
CPC ..... E21B 49/008; E21B 49/00; E21B 49/08; E21B 49/082
See application file for complete search history.

(56) References Cited

U.S. PATENT DOCUMENTS 3,611,799 A * 10/1971 Mike ..... E21B 49/10 73/152.24
5,442,173 A * 8/1995 Wraight ..... E21B 43/26 250/260

(Continued)

OTHER PUBLICATIONS

Raghuraman et al., Real-Time Downhole pH Measurement Using Optical Spectroscopy, SPE 93057, Houston, Texas, U.S.A., Feb. 2-4, 2005 (11 pages).

*Primary Examiner* — Yong-Suk Ro
(74) *Attorney, Agent, or Firm* — Trevor G. Grove

(57) ABSTRACT

A downhole acquisition tool having a formation testing module is provided. The formation testing module includes a fluid chamber comprising a piston and configured to store a fluid and to receive a flowback fluid from a geological formation, wherein the fluid is substantially free of solids. Additionally, the formation testing tool has a first conduit fluidly coupled to the fluid chamber and extending from a flowback conduit and a first outlet of the formation testing module, wherein the flowback conduit is configured fluidly coupled to the geological formation. and configured to receive the flowback fluid from the geological formation, and wherein the first conduit is configured to receive the flowback fluid from the flowback conduit. Further, the formation testing module has a first flow control device positioned downstream from the fluid chamber, wherein the first flow control device is configured to control a flow of the fluid exiting the fluid chamber.

20 Claims, 5 Drawing Sheets

Related U.S. Application Data which is a division of application No. 14/301,963, filed on Jun. 11, 2014, now Pat. No. 9,845,673.

(56) References Cited

U.S. PATENT DOCUMENTS 5,934,374 A 8/1999 Hrametz et al.
6,092,416 A 7/2000 Halford et al.
6,325,146 B1 * 12/2001 Ringgenberg ..... E21B 21/002 166/250.17
6,347,666 B1 2/2002 Langseth
6,352,110 B1 3/2002 Langseth et al.
6,357,525 B1 3/2002 Langseth et al.
6,382,315 B1 5/2002 Langseth
6,439,306 B1 8/2002 Patel
6,467,544 B1 10/2002 Brown et al.
6,659,177 B2 12/2003 Bolze et al.
6,688,390 B2 * 2/2004 Bolze ..... E21B 49/081 166/264
7,083,009 B2 8/2006 Paluch et al.
7,090,012 B2 * 8/2006 Hill ..... E21B 49/10 166/264
7,140,436 B2 11/2006 Grant et al.
7,158,887 B2 1/2007 Betancourt et al.
7,195,063 B2 3/2007 Nogueira et al.
7,243,536 B2 7/2007 Bolze et al.
7,293,715 B2 11/2007 Bargach et al.
7,379,819 B2 5/2008 Betancourt et al.
7,546,885 B2 * 6/2009 Longfield ..... E21B 49/083 175/50
7,596,995 B2 10/2009 Irani et al.
7,621,325 B2 11/2009 Shammai et al.
8,397,817 B2 3/2013 Edwards
8,794,318 B2 * 8/2014 Harrigan ..... E21B 49/008 166/100
9,322,266 B2 4/2016 Glattetre et al.
9,845,673 B2 12/2017 Gisolf et al.
2005/0150287 A1 * 7/2005 Carnegie ..... E21B 49/081 73/152.28
2008/0245570 A1 * 10/2008 Partouche ..... E21B 17/02 175/48
2010/0157737 A1 6/2010 Miller et al.
2012/0227963 A1 9/2012 Dumlupinar et al.
2013/0219997 A1 * 8/2013 Sullivan ..... E21B 49/10 73/53.01
2014/0131037 A1 5/2014 Hsu et al.
2016/0215617 A1 7/2016 Samec et al.
2018/0106148 A1 4/2018 Gisolf et al.

* cited by examiner

SYSTEM AND METHOD FOR CONTROLLED FLOWBACK

CROSS-REFERENCE TO RELATED APPLICATIONS

This application is a continuation in part of U.S. patent application Ser. No. 15/843,577 entitled "SYSTEM AND METHOD FOR CONTROLLED PUMPING IN A DOWNHOLE SAMPLING TOOL," filed on Dec. 15, 2017, which claims benefit to U.S. Pat. No. 9,845,673 entitled "SYSTEM AND METHOD FOR CONTROLLED PUMPING IN A DOWNHOLE SAMPLING TOOL," filed on Jun. 11, 2014, which are herein incorporated by reference.

BACKGROUND

This disclosure relates generally to downhole tools and more specifically to tools for formation stress testing.

Downhole acquisition tools are used to extract quantitative information of formation rock stresses during certain drilling operations. The formation rock stress information may facilitate predicting geo-mechanical problems that may be associated with a wellbore of interest. For example, vertical stress, minimum horizontal stress, maximum horizontal stress, and azimuth of minimum horizontal stress are geo-stresses that may be used to characterize formation rock stress. These stress parameters may be estimated using various techniques. For example, vertical stress may be estimated from an integral of a density log obtained using the downhole acquisition tool. Minimum horizontal stress may be estimated using fracturing techniques and/or leak-off data, and its direction from borehole caliper or image analysis. During formation testing to estimate the minimum horizontal stress of the formation rock, the downhole acquisition tool injects a fluid into the formation to create a fracture. In particular, the downhole acquisition tool pumps a fluid into the formation, thereby causing a local increase in pressure at the injection site. The pressure continues to buildup until the formation rock mechanically fails and fractures. In certain instances, existing formation rock fractures may be reopened by injecting the fluid into the existing fractures. Following fracture, the injected fluid exits the fracture and a closure event (e.g., closing of the fracture) occurs. The minimum horizontal stress of the formation rock may be determined based on fracture closure pressure (e.g., the amount of pressure observed when the fracture closed).

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, the present techniques are directed to a downhole acquisition tool that includes a formation testing module comprising. Further, the downhole acquisition tool has a fluid chamber comprising a piston and configured to store a fluid and to receive a flowback fluid from a geological formation, wherein the fluid is substantially free of solids. The downhole acquisition tool also has a first conduit fluidly coupled to the fluid chamber and extending from a flowback conduit and a first outlet of the formation testing module, wherein the flowback conduit is configured fluidly coupled to the geological formation and configured to receive the flowback fluid from the geological formation, and wherein the first conduit is configured to receive the flowback fluid from the flowback conduit. Further still, the downhole acquisition tool has a first flow control device positioned downstream from the fluid chamber, wherein the first flow control device is configured to control a flow of the fluid exiting the fluid chamber.

In another embodiment, the present techniques are directed to a formation testing module comprising a fluid chamber configured to store a fluid and to receive a flowback fluid, wherein the fluid is substantially free of solids. The formation testing module includes a piston disposed within the fluid chamber. The formation testing module also includes a first conduit fluidly coupled to the fluid chamber and extending from a flowback conduit and a first outlet of the formation testing module, wherein the first conduit is configured to receive the flowback fluid exiting from a fracture within a geological formation, and wherein the flowback conduit is fluidly coupled to the fracture such that the flowback conduit receives and directs the flowback fluid to the first conduit. Further, the formation testing module includes a first flow control device positioned between an inlet of the fluid chamber and the flowback conduit, wherein the first flow control device is configured to enable flow of the flowback fluid into the fluid chamber; and wherein the piston is configured to move toward a fluid chamber outlet to displace the fluid in response to a flow of the flowback fluid into the fluid chamber. Further still, the formation testing module includes a sensor disposed downstream of the fluid chamber outlet, wherein the sensor is configured to detect a property of the fluid, and wherein the property of the fluid is indicative of a minimum horizontal stress of the formation. In another embodiment, the present techniques are directed to a method that includes positioning a downhole tool into a wellbore within a geological formation. The method also includes injecting a first fluid into a region of the geological formation isolated using a plurality of packers of the downhole tool, wherein the first fluid is configured to create a fracture within the isolated region of the geological formation. Further, the method includes determining a minimum horizontal stress of the formation, wherein determining the minimum horizontal stress of the formation comprises. Even further, the method includes receiving a flowback flow of the first fluid from the fracture in the geological formation, wherein the downhole tool comprises a flowback conduit fluidly coupled to the fracture and configured to receive the flowback flow of the first fluid. The method also includes directing the flowback flow to a fluid chamber disposed within a formation testing module of the downhole tool, wherein the fluid chamber comprises a piston and a second fluid, wherein the second fluid is substantially free of solids. Further still, the method includes displacing a volume of the second fluid from the fluid chamber in response to the flowback flow of the first fluid into the fluid chamber, wherein the flowback flow is configured to move the piston in a direction toward a first port of the fluid chamber and to displace the second fluid through the port. Additionally, the method includes measuring a property of the second fluid downstream of the fluid chamber using a sensor positioned along a flow path of the second fluid, wherein the property of the second fluid is representative of the minimum horizontal stress of the formation.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
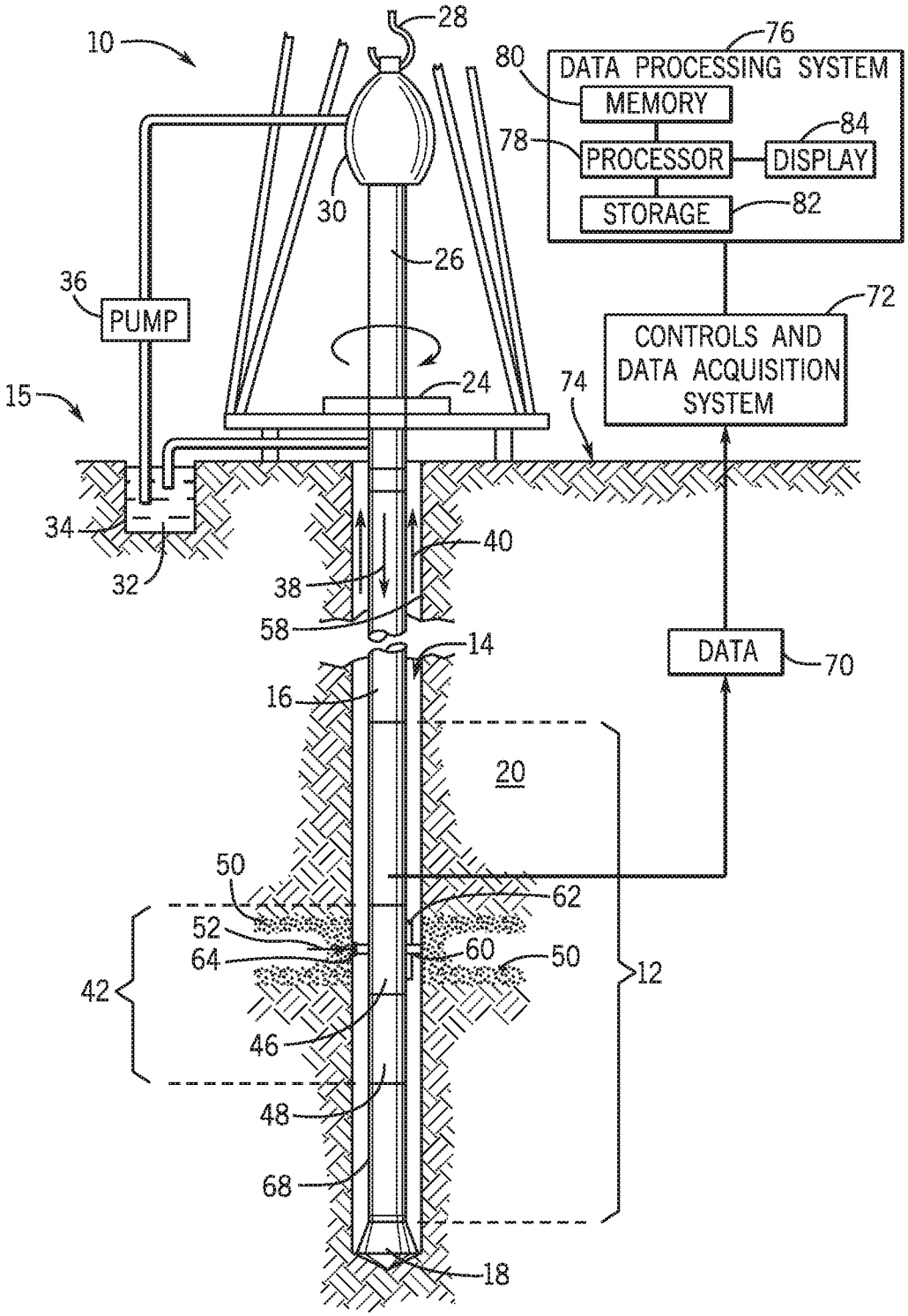
FIG. 1 is a partial cross sectional view of a drilling system used to drill a well through subsurface formations, in accordance with an embodiment of the present techniques.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, a "flowback fluid" is intended to denote a fluid flowing from an area (e.g., a formation) as a result of a treatment (e.g., after injecting fluid into a formation). As used herein, a "fall off" is intended to denote the period when the pressure in the fracture decline. As used herein, "flow back" is when fluid is removed from the fracture through use of a tool. As used herein, "leak-off", is intended to denote when a fluid is ejected from a formation due to the magnitude of pressure exerted on the formation.

Formation stress testing provides information about the properties of a subsurface formation such as the minimum horizontal stress, which indicates the maximum pressure an existing fracture can be exposed to before it will being fracturing. This information may be useful for optimizing the extraction of oil and gas from a subsurface formation. During formation stress testing, a downhole tool is inserted into a wellbore and injects a fluid into the formation to create a fracture. For example, the downhole tool may include a Dual packer that isolates a section of the wellbore using two inflatable packer elements. The Dual packer then makes pressure measurements during the formation stress testing based at least in part on formation fluid expelled after the fracture is formed.

However, determining the minimum stress of less permeable formations (e.g., shale) is challenging. During formation testing, microfractures are created within the formation and a minimum stress of the formation measured. For example, a downhole tool (e.g., a formation tester) injects a fluid into the formation to induce a microfracture. After a formation fracture is initiated and propagated by pumping the fluid into the fracture, a decrease in pressure is measured as the injected fluid flows out of the fracture. The decrease in the pressure as the fluid exits the microfracture may be associated with a minimum horizontal stress of the formation. For example, as the fluid exits the microfracture, the microfracture begins to close. The moment in which the microfracture closes is essentially equal to the minimum horizontal stress of the formation. In permeable (e.g., porous) formations, the injected fluid leaks out of the microfracture and into the formation, thereby closing the microfracture. However, in formations having low permeability, such as shale or tight formations, the injected fluid may not leak out of the microfracture. Therefore, the injected fluid may be directed back to the downhole tool. However, the injected fluid may exit the microfracture and flow into the downhole tool at an unsuitable rate. As such, it may be difficult to determine the minimum horizontal stress of the formation. Additionally, a composition of the injected fluid may include undesirable solids, which damage certain components of the downhole tool. It has been recognized that by controlling fluid flowback from the microfracture into the downhole tool, the accuracy of closure pressure of the microfracture may be improved. Moreover, to mitigate damage of components of the downhole tool that may be caused by the injected fluid, it is now recognized that a buffer fluid may be used to separate certain components of the downhole tool from the injected fluid when the injected fluid flows back into the downhole tool.

Certain techniques may require that the flowback happens either at a constant flow rate or across a constant choke. In this way, the flowback rate and volume is known or may be reasonably approximated throughout the operation and the accuracy of the fracture pressure may be determined more readily. However, determination of minimum stress may be difficult in formations having low permeability (e.g., shale).

Accordingly, certain embodiments of the present disclosure include a downhole tool that includes a fluid sample module having a sample chamber used to separate the injected fluid from a certain components of the downhole tool that may be affected by solids in the injected fluid. The sample chamber receives the injected fluid flowing back into the downhole tool from the induced microfracture. As discussed in further detail below, the sample chamber includes a buffer fluid that that is directed to a flow path having a flow control device (e.g., a choke or relief valve) that controls the flowback rate of the injected fluid. The volume of the buffer fluid displaced from the sample chamber by the flowback may be used in the process to determine the closure pressure of the microfracture. In this way, the flow of the injected fluid back into the downhole tool may be controlled in a manner that enables accurate determination of the minimum horizontal stress of the microfracture.

Figure 2:
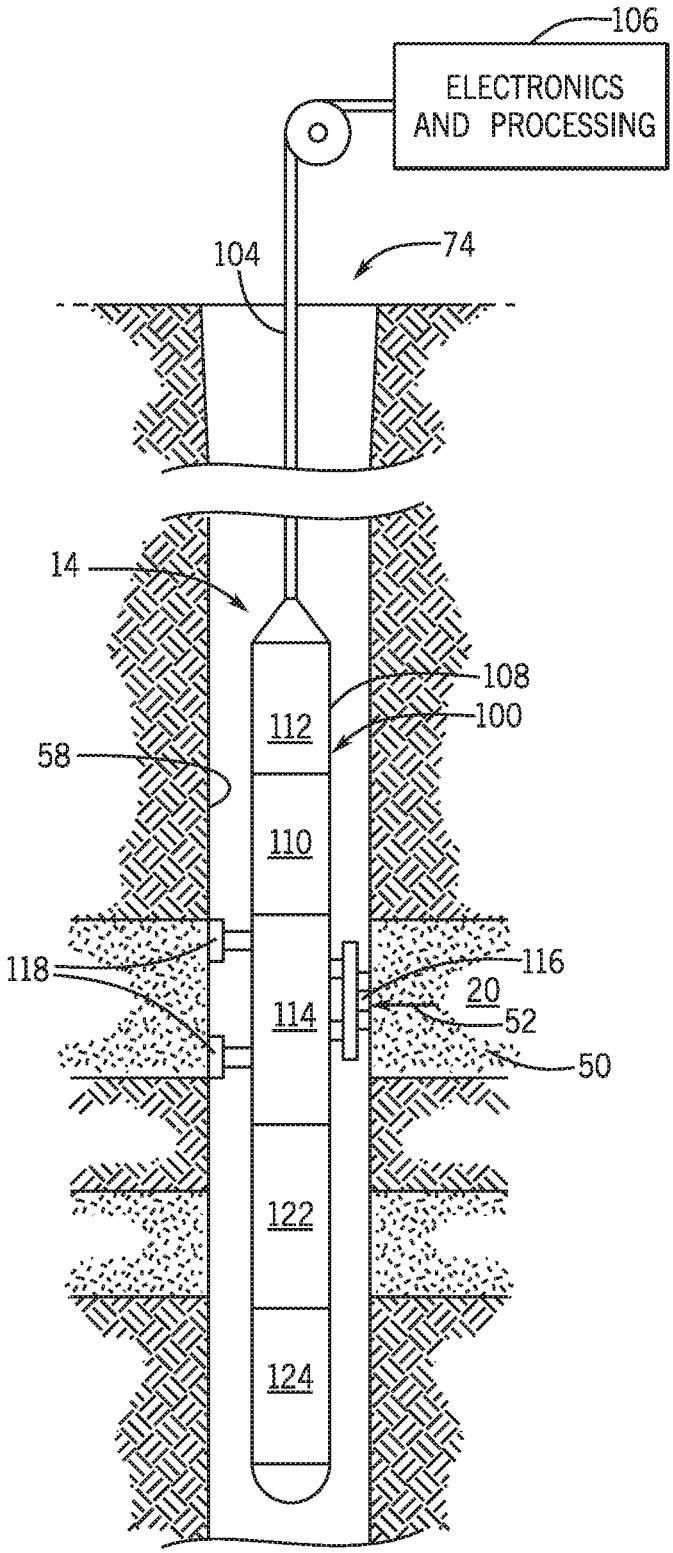
FIG. 2 is a schematic diagram of downhole equipment having various testing modules used to determine one or more characteristics of the subsurface formation, in accordance with an embodiment of the present techniques.

With the foregoing in mind, FIGS. 1 and 2 depict examples of wellsite systems that may employ the formation stress tester and techniques described herein. FIG. 1 depicts a rig 10 with a downhole acquisition tool 12 suspended therefrom and into a wellbore 14 of a reservoir 15 via a drill string 16. The downhole acquisition tool 12 has a drill bit 18 at its lower end thereof that is used to advance the downhole acquisition tool 12 into geological formation 20 and form the wellbore 14. The drill string 16 is rotated by a rotary table 24, energized by means not shown, which engages a kelly 26 at the upper end of the drill string 16. The drill string 16 is suspended from a hook 28, attached to a traveling block (also not shown), through the kelly 26 and a rotary swivel 30 that permits rotation of the drill string 16 relative to the hook 28. The rig 10 is depicted as a land-based platform and derrick assembly used to form the wellbore 14 by rotary drilling. However, in other embodiments, the rig 10 may be an offshore platform.

Formation fluid or mud 32 (e.g., oil base mud (OBM) or water-based mud (WBM)) is stored in a pit 34 formed at the well site. A pump 36 delivers the formation fluid 52 to the interior of the drill string 16 via a port in the swivel 30, inducing the drilling mud 32 to flow downwardly through the drill string 16 as indicated by a directional arrow 38. The formation fluid exits the drill string 16 via ports in the drill bit 18, and then circulates upwardly through the region between the outside of the drill string 16 and the wall of the wellbore 14, called the annulus, as indicated by directional arrows 40. The drilling mud 32 lubricates the drill bit 18 and carries formation cuttings up to the surface as it is returned to the pit 34 for recirculation.

The downhole acquisition tool 12, sometimes referred to as a bottom hole assembly ("BHA"), may be positioned near the drill bit 18 and includes various components with capabilities, such as measuring, processing, and storing information, as well as communicating with the surface. A telemetry device (not shown) also may be provided for communicating with a surface unit (not shown). As should be noted, the downhole acquisition tool 12 may be conveyed on wired drill pipe, a combination of wired drill pipe and wireline, or other suitable types of conveyance.

In certain embodiments, the downhole acquisition tool 12 includes a downhole analysis system. For example, the downhole acquisition tool 12 may include a sampling system 42 including a fluid communication module 46 and a sampling module 48. The modules may be housed in a drill collar for performing various formation evaluation functions, such as pressure testing and fluid sampling, among others. As shown in FIG. 1, the fluid communication module 46 is positioned adjacent the sampling module 48; however the position of the fluid communication module 46, as well as other modules, may vary in other embodiments. Additional devices, such as pumps, gauges, sensor, monitors or other devices usable in downhole sampling and/or testing also may be provided. The additional devices may be incorporated into modules 46, 48 or disposed within separate modules included within the sampling system 42.

The downhole acquisition tool 12 may evaluate fluid properties of reservoir fluid 50. Accordingly, the sampling system 42 may include sensors that may measure fluid properties such as gas-to-oil ratio (GOR), mass density, optical density (OD), composition of carbon dioxide ($CO_2$), $C_1$, $C_2$, $C_3$, $C_4$, $C_5$, and $C_{6+}$, formation volume factor, viscosity, resistivity, fluorescence, American Petroleum Institute (API) gravity, and combinations thereof of the reservoir fluid 50. The fluid communication module 46 includes a probe 60, which may be positioned in a stabilizer blade or rib 62. The probe 60 includes one or more inlets for receiving the formation fluid 52 and one or more flowlines (not shown) extending into the downhole acquisition tool 12 for passing fluids (e.g., the reservoir fluid 50) through the tool. In certain embodiments, the probe 60 may include a single inlet designed to direct the reservoir fluid 50 into a flowline within the downhole acquisition tool 12. Further, in other embodiments, the probe 60 may include multiple inlets that may, for example, be used for focused sampling. In these embodiments, the probe 60 may be connected to a sampling flowline, as well as to guard flowlines. The probe 60 may be movable between extended and retracted positions for selectively engaging the wellbore wall 58 of the wellbore 14 and acquiring fluid samples from the geological formation 20. One or more setting pistons 64 may be provided to assist in positioning the fluid communication device against the wellbore wall 58.

In certain embodiments, the downhole acquisition tool 12 includes a logging while drilling (LWD) module 68. The module 68 includes a radiation source that emits radiation (e.g., gamma rays) into the formation 20 to determine formation properties such as, e.g., lithology, density, formation geometry, reservoir boundaries, among others. The gamma rays interact with the formation through Compton scattering, which may attenuate the gamma rays. Sensors within the module 68 may detect the scattered gamma rays and determine the geological characteristics of the formation 20 based at least in part on the attenuated gamma rays.

The sensors within the downhole acquisition tool 12 may collect and transmit data 70 (e.g., log and/or DFA data) associated with the characteristics of the formation 20 and/or the fluid properties and the composition of the reservoir fluid 50 to a control and data acquisition system 72 at surface 74, where the data 70 may be stored and processed in a data processing system 76 of the control and data acquisition system 72.

The data processing system 76 may include a processor 78, memory 80, storage 82, and/or display 84. The memory 80 may include one or more tangible, non-transitory, machine readable media collectively storing one or more sets of instructions for operating the downhole acquisition tool 12, determining formation characteristics (e.g., geometry, connectivity, minimum horizontal stress, etc.) calculating and estimating fluid properties of the reservoir fluid 50, modeling the fluid behaviors using, e.g., equation of state models (EOS). The memory 80 may store reservoir modeling systems (e.g., geological process models, petroleum systems models, reservoir dynamics models, etc.), mixing rules and models associated with compositional characteristics of the reservoir fluid 50, equation of state (EOS) models for equilibrium and dynamic fluid behaviors (e.g., biodegradation, gas/condensate charge into oil, $CO_2$ charge into oil, fault block migration/subsidence, convective currents, among others), and any other information that may be used to determine geological and fluid characteristics of the formation 20 and reservoir fluid 52, respectively. In certain embodiments, the data processing system 54 may apply filters to remove noise from the data 70.

To process the data 70, the processor 78 may execute instructions stored in the memory 80 and/or storage 82. For example, the instructions may cause the processor to compare the data 70 (e.g., from the logging while drilling and/or downhole analysis) with known reservoir properties estimated using the reservoir modeling systems, use the data 70 as inputs for the reservoir modeling systems, and identify geological and reservoir fluid parameters that may be used for exploration and production of the reservoir. As such, the memory 80 and/or storage 82 of the data processing system 76 may be any suitable article of manufacture that can store the instructions. By way of example, the memory 80 and/or the storage 82 may be ROM memory, random-access memory (RAM), flash memory, an optical storage medium, or a hard disk drive. The display 84 may be any suitable electronic display that can display information (e.g., logs, tables, cross-plots, reservoir maps, etc.) relating to properties of the well/reservoir as measured by the downhole acquisition tool 12. It should be appreciated that, although the data processing system 76 is shown by way of example as being located at the surface 74, the data processing system 76 may be located in the downhole acquisition tool 12. In such embodiments, some of the data 70 may be processed and stored downhole (e.g., within the wellbore 14), while some of the data 70 may be sent to the surface 74 (e.g., in real time). In certain embodiments, the data processing system 76 may use information obtained from petroleum system modeling operations, ad hoc assertions from the operator, empirical historical data (e.g., case study reservoir data) in combination with or lieu of the data 70 to determine certain parameters of the reservoir 8.

FIG. 2 depicts an example of a wireline downhole tool 100 that may employ the systems and techniques described herein to determine formation and fluid property characteristics of the reservoir 15. The wireline downhole tool 100 is suspended in the wellbore 14 from the lower end of a multi-conductor cable 104 that is spooled on a winch at the surface 74. Similar to the downhole acquisition tool 12, the wireline downhole tool 100 may be conveyed on wired drill pipe, a combination of wired drill pipe and wireline, or other suitable types of conveyance. The cable 104 is communicatively coupled to an electronics and processing system 106. The wireline downhole tool 100 includes an elongated body 108 that houses modules 110, 112, 114, 122, and 124 that provide various functionalities including imaging, fluid sampling, fluid testing, operational control, and communication, among others. For example, the modules 110 and 112 may provide additional functionality such as fluid analysis, resistivity measurements, operational control, communications, coring, and/or imaging, among others.

As shown in FIG. 2, the module 114 is a fluid communication module 114 that has a selectively extendable probe 116 and backup pistons 118 that are arranged on opposite sides of the elongated body 108. The extendable probe 116 is configured to selectively seal off or isolate selected portions of the wall 58 of the wellbore 14 to fluidly couple to the adjacent geological formation 20 and/or to draw fluid samples from the geological formation 20. The probe 116 may include a single inlet or multiple inlets designed for guarded or focused sampling. The reservoir fluid 50 may be expelled to the wellbore through a port in the body 108 or the formation fluid 50 may be sent to one or more modules 122 and 124. The modules 122 and 124 may include sample chambers that store the reservoir fluid 50. In the illustrated example, the electronics and processing system 106 and/or a downhole control system are configured to control the extendable probe assembly 116 and/or the drawing of a fluid sample from the formation 20 to enable analysis of the fluid properties of the reservoir fluid 50, as discussed above.

In some embodiments, the module 114 may be used for formation stress testing. For example, one or more of the extendable probes 116 may be used to inject a fluid into the geological formation 20 until a fracture forms. After the fracture forms, resulting in the release of flowback fluid or formation fluid 52 from the formation, one or more of the extendable probes 116 receive the fluid. The extendable probes 116 receiving the fluid may be coupled to one or more formation testing chambers 122 and/or 124, which determine a property of the formation.

As discussed above, during formation stress testing, a fluid is injected into the formation to create a microfracture. The downhole tool measures a closure pressure of the microfracture to determine the minimum horizontal stress of the formation. During propagation of the microfracture, the pressure in the microfracture and the dual packer interval of the downhole tool is higher than the borehole pressure. The pressure within the microfracture beings to decrease as the injected fluid exits the microfracture. In formations having low permeability, the injected fluid flows back into the downhole tool to allow the microfracture to close. As such, a flow of the injected fluid back into the downhole tool 12 may need to be controlled due, in part, to a change in pressure between the fluid in the microfracture and the borehole. For example, the injected fluid flows from a higher pressure in the microfracture to a lower pressure in the borehole. The downhole tool includes a pump out module that may pump fluid from a lower pressure at an inlet side of the pump to a higher pressure downstream of the pump. If a pressure at the inlet side is higher than the pressure at a pump discharge side, the injected fluid may flow through the pump in an uncontrolled manner. Accordingly, a pressure relief valve may be placed at the discharge side of the pump to increase a discharge pressure of the flowback fluid. The downhole tool may also include a relief valve positioned at a location that may enable the pump discharge pressure to be higher than the pump inlet pressure. Therefore, the pump may control the flowback of the injected fluid into the downhole tool.

Figure 3:
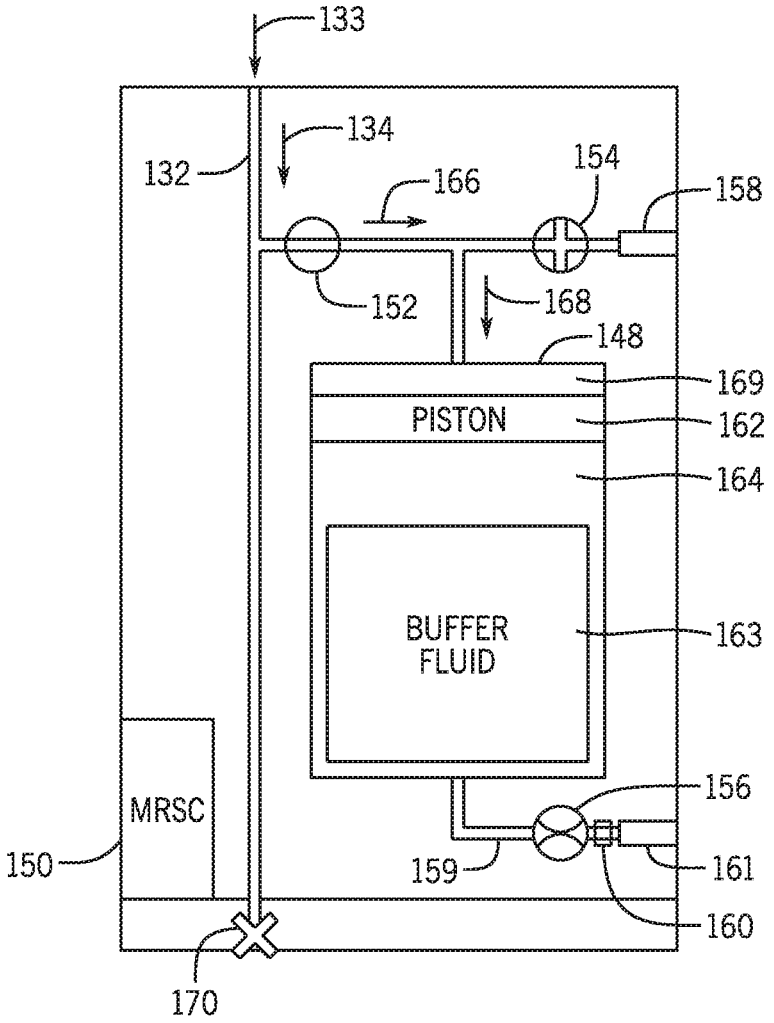
FIG. 3 is a schematic diagram of an embodiment of a downhole tool having a formation testing module that includes a fluid chamber having a buffer fluid, in accordance with an embodiment.

FIG. 3 is a schematic diagram of an embodiment of the formation testing module 122 of the downhole tool 100. In the illustrated embodiment, the formation testing module 122 includes a fluid chamber 162 that includes a buffer fluid 163 that separates the flowback fluid 133 exiting the formation from a flow control device 156. The buffer fluid 163 mitigates plugging and/or damage of the control device 156 by solids that may be present in the flowback fluid. Additionally, as discussed in further detail below, the buffer fluid 163 may facilitate measurement of the closure pressure of the microfracture used to determine the minimum horizontal stress of the formation. The downhole tool 100 includes a conduit 132 that receives a flowback fluid 133 exiting the microfracture after the pump 36 stops injecting fluid into the formation. The conduit 132 directs the flowback fluid 133 toward the fluid chamber 162 in the direction 134.

The formation testing module 122 includes a valve 152 which may control flow of the flowback fluid 133 into the fluid chamber 162. For example, in one embodiment, the valve 152 may be positioned along the first conduit 132 at a junction between the first conduit 132 and a second conduit 166. The second conduit 166 is in fluid communication with the fluid chamber 148, via a third conduit 168, and directs the flowback fluid 133 toward the fluid chamber 162. The valve 152 may include a one-way seal valve. The valve 152 controls a flow of the flowback fluid 133 through the second conduit 166 based on a control signals output from the controller 150 or control and data acquisition system in response to instructions received by an operator. For example, an operator may be monitoring a pressure in a Dual-packer interval. Upon seeing a pressure change that is indicative of a fracture forming, the operator may use the control and data acquisition system 72, or a suitable controller, to send control signals to actuate (e.g., in this case, open) the valve 152. In some embodiments, the second conduit 122 may include a drain valve 154 that controls a flow of the flowback fluid 133 exiting the downhole tool 12. For example, the operator may determine that a suitable amount of flowback fluid 133 has been received from the formation 20 for determining the minimum horizontal stress of the formation. As such, the operator may open the drain valve 152 to release any excess flowback fluid 133. The controller 150 may output a signal to the drain valve 158 that instructs the drain valve 158 to open and enable the flowback fluid 133 to exit the formation testing module 122 via an outlet 161.

As discussed above, the buffer fluid 163 may be used to indirectly measure the closure pressure of the microfracture and block flow of the flowback fluid 133 through certain flow control devices (e.g., valves, chokes, and the like) that may be plugged and/or damaged due to solids in the flowback fluid 133. The property (e.g., flow rate, pressure, and temperature) of the buffer fluid 163 may be measured continuously or periodically. Based on known properties of the buffer fluid, a flow rate may be determined which is indicative of a pressure of the formation fluid. For example, a flow volume of the buffer fluid 163 may be determined based on the flow rate.

The chamber 148 may store a known volume of the buffer fluid 163. A known volume of the buffer 163 is useful for accurately determining the flow rate. In operation, the fluid chamber 148 receives the flowback fluid 133 exiting the microfracture through a third conduit 168 fluidly coupled to the conduits 132, 166 when the valve 152 is opened. As the flowback fluid 133 flows into the fluid chamber 148 via the third conduit 168, the flowback fluid 133 fills a second volume 169 of the fluid chamber 148, which displaces a piston 162 within the fluid chamber 148. The piston may separate the volume of the sample chamber into two volumes. The formation fluid may flow into the first volume and a second fluid within the second volume may flow as a result of the movement of the piston induced by the flowing formation fluid. Certain properties such as the flow rate, pressure, and/or temperature of the first and/or second fluid may be measured to determine properties of the formation, such as the minimum stress. That is, while the minimum horizontal stress may be determined from a pressure vs time plot measured by a Dual-packer module, a more accurate method to determine the minimum horizontal stress is from a pressure vs volume plot. The flowrate of the buffer fluid 163 may be measured by a sensor 160, and the flowrate may be integrated to generate the volume versus time of the buffer fluid 163. A pressure versus volume plot can be generated from the pressure versus time plot with the volume versus time plot, and thus, the measurements of the buffer fluid 163 may be used to determine the horizontal minimum stress of the formation.

For example, the flowback fluid 133 applies pressure to the piston 162, thereby moving the piston 162 in the direction 134. As the piston 162 moves in the direction 134, the piston displaces a portion of the buffer fluid 163 out of the fluid chamber 148 and into a fourth conduit 159. The buffer fluid 163 may flow through one or more flow control devices 156 (e.g., a choke, a relief valves, or the like) positioned along the fourth conduit 159. In certain embodiments, multiple flow control devices 156 may be positioned along the fourth conduit 159. By placing multiple control devices 156 along the fourth conduit 159, the flow of the buffer fluid 163 along fourth conduit 159 may be decreased, resulting in a slow detected pressure drop (e.g., decrease). By slowing the pressure drop, a more accurate determination of the fall off pressured may be determined as more data may be acquired during the fall off phase.

A sensor 160 may be positioned downstream of the flow control device 156 that measures a characteristic of the buffer fluid 163. For example, in certain embodiments, the sensor 160 is a pressure sensor that measures a pressure of the buffer fluid 163. In other embodiments, the sensor 160 is a flow rate sensor, viscosity sensor, temperature sensor, or any suitable sensor that may measure a property of the fluid that correlates with the flow rate, volume or pressure acted on the buffer fluid 163 by the formation fluid within the chamber 148. In the illustrated embodiment, the sensor 160 is positioned adjacent to an outlet 161 of the formation testing module 122. However, the sensor 160 may be positioned at any suitable location along the fourth conduit 159. Additional sensors may be positioned along the fourth conduit 159. For example, the fourth conduit 159 may have 2, 3, 4, 5, or more sensors that measure one or more characteristics of the buffer fluid 163. The buffer fluid 163 may be kept at wellbore or downhole pressure while in the fluid chamber 148. One of ordinary skill in the art may recognized that this presents several advantages. For example, the viscosity of a fluid increases with increasing pressure, and thus, it may be easier to correlate measurements of the buffer fluid and the pressure of the fracture on the formation fluid as the buffer fluid and the formation fluid will have similar properties affecting the flow.

The buffer fluid 163 may be any type of fluid having properties (e.g., density and/or viscosity) suitable for downhole conditions (e.g., high temperature). For example, the buffer fluid 163 may have a viscosity between approximately 10 centipoise (cP) and approximately 200 cP at downhole conditions. In embodiments where the viscosity of the buffer is low (e.g., less than approximately 10 cp) at the downhole conditions, multiple flow control devices 156 may be positioned along the fourth conduit 159 in series to facilitate a steady flow of the buffer fluid 163.

As discussed above, the buffer fluid 163 may be displaced from the fluid chamber 148 and exit the formation testing module 122 via the outlet 160 and into the borehole. However, in some embodiments, it may be desirable to recycle the buffer fluid 163. Recycling the buffer fluid 163 may be desirable in embodiments where multiple or repeat measurements are performed.

Figure 4:
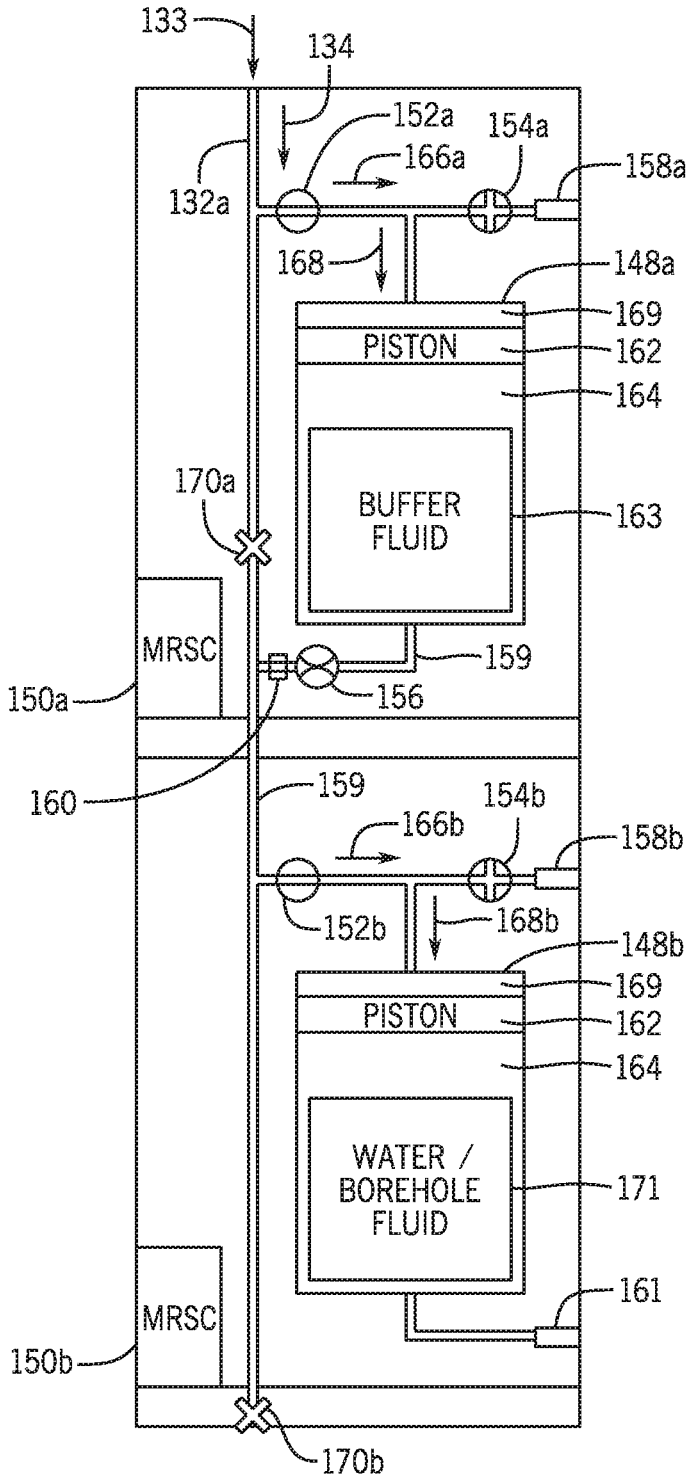
FIG. 4 is a schematic diagram of an embodiment of the downhole tool of FIG. 3, whereby the formation testing module includes a second fluid chamber that receives at least a portion of the buffer fluid from the fluid chamber, in accordance with an embodiment.

FIG. 4 is a schematic diagram of an embodiment of a formation testing module 122 having multiple fluid chambers. For example, in the illustrated embodiment, the formation testing module 122 includes the fluid chamber **148*a* and a second fluid chamber 148*b* positioned downstream of the fluid chamber 148*a*. In the illustrated embodiment, rather than having the displaced buffer fluid 163 exit the formation testing module 122 via an outlet 160, the buffer fluid 163 is directed to the second fluid chamber 148*b* and recycled. As noted above, recycling the buffer fluid 163 may be desirable when repeat or multiple measurements are performed by the formation testing module 122**.

For example, flowing through the flow control device 156, the buffer fluid 163 may flow into the second fluid chamber 148*b* via the first conduit 132. Following displacement of the buffer fluid 163 from the volume 164, the fourth conduit 159 directs the displaced buffer fluid 163 to the first conduit 132. A plug 170 may be positioned along the first conduit 132 upstream of the flow control device 156 such that flowback fluid 133 flowing through the first conduit 132 in the direction 134 does not flow past the plug 170 and mix with the displaced buffer fluid 163 at or below the junction between the conduits 132, 159.

A sensor 160 may be positioned downstream of the flow control device 156 that measures a characteristic of the buffer fluid 163. While the probes 116 or a Dual-packer module may be suitable for determining pressure versus time of the flow back fluid 113, in certain embodiments, the sensor 160 is a pressure sensor that measures a pressure of the buffer fluid 163 at a different position within the formation testing module 122. In other embodiments, the sensor 160 is a flow rate sensor, temperature sensor, viscosity sensor or any suitable sensor that may measure a property of the fluid that correlates with the volume of the buffer fluid 163 displaced by the formation fluid within the chamber 148 and flowing out of the chamber 148. In the illustrated embodiment, the sensor 160 is positioned adjacent to an outlet 161 of the formation testing module 122. However, the sensor 160 may be positioned at any suitable location along the fourth conduit 159. Additional sensors may be positioned along the fourth conduit 159. For example, the fourth conduit 159 may have 2, 3, 4, 5, or more sensors that measure one or more characteristics of the buffer fluid 163. The buffer fluid 163 may be kept at wellbore or downhole pressure while in the fluid chamber 148. One of ordinary skill in the art may recognized that this presents several advantages. For example, the viscosity of a fluid increases with increasing pressure, and thus, it may be easier to correlate measurements of the buffer fluid and the pressure of the fracture on the formation fluid as the buffer fluid and the formation fluid will have similar properties affecting the flow.

The buffer fluid 163 in the first conduits 132 is fluidly coupled to the second fluid chamber 148*b*, via the second conduit 166*b* and the third conduit 168, when valve 152 is opened. The chamber 148*b* may store a known volume of the fluid 171, such as water or borehole fluid. For example, the fluid 171 may be pumped from the borehole via the outlet 161 by a pump. As the buffer fluid 163 flows into the second fluid chamber 148*b* via a second, the flowback fluid 133 fills a second volume 169 of the fluid chamber 148*b*, which displaces a piston 162 within the fluid chamber 148*b*. The piston may separate the volume of the sample chamber into two volumes. The formation fluid may flow into the first volume and a second fluid within the second volume may flow as a result of the movement of the piston induced by the flowing formation fluid. As noted above, fluid 171 may be pumped into the second fluid chamber 148*b*. The pumped fluid 171 may flow into the second volume 164 and the buffer fluid 163 in the first volume 164 of the fluid chamber 148*b* may be recycled back into fluid chamber 148*a*. As such, measurement process mentioned above may be repeated (e.g., receiving additional flow of flowback fluid 133. In some embodiments, the flow control device 156 may be a check-relief system that may facilitate faster recycling of the buffer fluid 163. In some embodiments, the first chamber 148*a* and the second chamber 147*b* may be coupled in parallel to a check valve.

Figure 5:
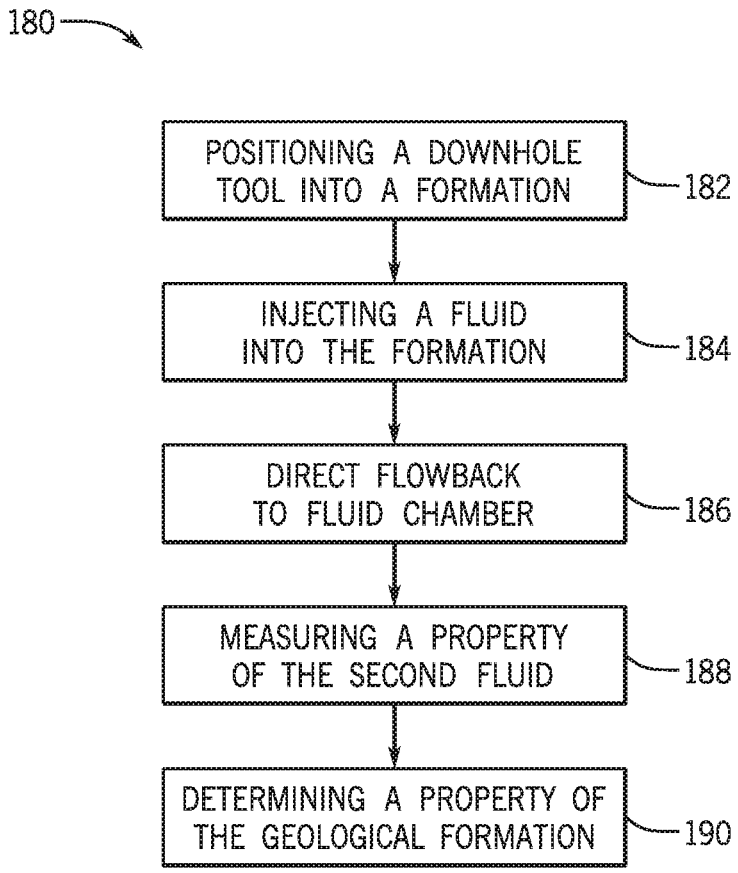
FIG. 5 is a flow diagram of a method for measuring minimum horizontal stress using the downhole tool of FIGS. 3 and 4, in accordance with an embodiment.

In general, FIG. 5 illustrates an embodiment of the present techniques that includes a second sample chamber 148*b* that is placed below the flowback chamber to receive the buffer fluid 163. Once a substantial portion of the buffer fluid 163 from a first sample chamber 148*a* is directed into a second sample chamber 148*b* (e.g., receiving chamber), a pump may be used to pump the mud or formation fluid out of the flowback chamber.

In embodiments where the buffer fluid 163 is recycled, the flow control device 156 may include a constant flow rate valve. The constant flow rate valve may maintain a constant flow rate across a broad range of pressure differentials between the fluids flowing in the conduits. In certain embodiments, the flow control device 156 may be a surface controlled electrical and/or hydraulic valve. In other embodiments, the flow control device 156 may be paired with a one directional bypass line (e.g., parallel choke and relief system) to mitigate choking during recycling of the buffer fluid 163.

FIG. 5 represents a flow diagram of an embodiment of a method 180 for using the downhole tool to perform formation stress-testing. It should be understood that the method 180 described below is not limited to be performed in the order presented herein; instead, the method 180 may be performed in any suitable order. The method 180 includes positioning the downhole acquisition tool 12 within a wellbore 14 (block 182). As discussed herein, the downhole acquisition tool 12 may include a Dual Packer that isolates a desired section of the wellbore. Once positioned in the desired section of the wellbore has been isolated, the method 180 includes injection a fluid into the formation to create a fracture (block 184). For example, the downhole tool includes a probe that injects a fluid (e.g., drilling fluid) into the formation to create a fracture. The downhole tool may include a pump that pumps the fluid through the probe and into the formation. The fracturing fluid may create a fracture in the geological formation when the pressure inside the geological formation exceeds the minimum horizontal stress of the formation.

Following injection of the fluid into the formation, the method 180 includes directing a flowback fluid exiting the microfraction to a fluid chamber within a formation testing module of the downhole tool 12 (block 186). The fluid sample module 122 receives the fluid flow (e.g., of flowback fluid 133) from the geological formation 120. More specifically, one or more conduits of the fluid sample module 122 receive the flowback fluid 133, and the flowback fluid 133 is directed into a fluid chamber 148. As discussed above, a buffer fluid 163 is displaced by the flowback fluid flowing into the fluid chamber 148 via a piston. The buffer fluid 163 is then directed to one or more sensors. As discussed above, the buffer fluid 163 may contain fewer abrasive substances than the flowback fluid 133 and is less likely to damage any subsequent features (e.g., valves, sensors, the conduits). In some embodiments, block 186 may involve one or more valves (e.g., seal valve 152 or valve 156) of the sample module 122 and/or seal valves 152 of the fluid sample module 124 actuating (e.g., opening) as a result of suitable control signals. One the fluid sample module 122 receives the flow of fluid from the geological formation, the fluid is directed into a fluid chamber 148. As discussed herein, the fluid chamber 148 directs a flow of buffer fluid from a volume 164 of the fluid chamber 148 by movement of the piston 162, and the movement of the piston 162 results from a flow of the fluid into a first volume or portion of the fluid chamber 148. In some embodiments, a valve (e.g., 156 or a choke valve) may be activated to modify or attenuate the flow rate of buffer fluid 163.

The method 180 also includes measuring a minimum horizontal stress of the formation based on a characteristic of the buffer fluid (block 188). Based on at least this measurement, a property of the formation (e.g., the minimum stress) may be determined (block 190). For example, the flow rate, pressure, and/or temperature of the buffer fluid 163 correlate to a pressure or amount of flowback fluid 133 in the volume 169 of the fluid chamber 148. Additionally, as discussed above, the amount or pressure of the flowback fluid 133 is related to the stress of the formation on the fracture. More specifically, the properties of the buffer fluid, such as pressure as a function of temperature, may be characterized or known. A choke or flow control device may be calibrated such that it can determine a flow rate based on a pressure differential (e.g., different in fracture pressure and borehole pressure). During the fall off, the pressure and temperature may be measured to calculate the flow rate. The flow rate is then integrated to obtain volume versus time, and the volume versus time plot is combined with the pressure versus time plot to determine a pressure versus volume plot that can be used to determine the minimum horizontal stress. Therefore, the measurements of the flow rate, pressure, and/or temperature of the buffer fluid 163 may be used to indirectly measured a property of the formation.

As discussed above, the techniques disclosed herein may be used to determine a property of a geological formation in a downhole tool using flowback fluid from the formation. The flowback fluid may contain solids or materials that may damage components within a formation testing module of the downhole tool, and therefore a buffer fluid may be used to indirectly measure the properties of the formation. That is, rather than measuring properties of the flowback fluid, the flowback fluid may be directed into a chamber and displace a volume of buffer fluid through suitable means, such as a piston. Additionally, various flow controllers may be disposed along a conduit that receives the buffer fluid such that the flow of the buffer fluid may be modified such that an accurate measurement of the properties of the flow of the buffer fluid may be obtained. The properties of the buffer fluid may be measured using various sensors disposed along a conduit that receives the buffer fluid. In other embodiments, a second formation testing module may be disposed in series with the first formation testing module. The second formation module may include a second chamber for receiving the buffer fluid. As the buffer fluid is flowing from the first chamber of the first formation testing module to the second chamber of the second formation test module, properties of the buffer fluid may be measured, which are indicative of a property of the formation. The buffer fluid in the second chamber may be directed back to the first chamber (e.g., after a measurement is completed). Using the disclosed techniques, more accurate determination of formation properties for certain formations (e.g., less permeable ones) may be obtained. Further, the disclosed techniques reduce the likelihood of damaging components within the downhole tool that may result from formation testing.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A downhole acquisition tool, comprising:

a formation testing module comprising:

a fluid chamber comprising a piston and configured to store a fluid and to receive a flowback fluid from a geological formation, wherein the fluid is substantially free of solids; a conduit fluidly coupled to the fluid chamber and extending from a flowback conduit and an outlet of the formation testing module, wherein the flowback conduit is configured fluidly coupled to the geological formation and configured to receive the flowback fluid from the geological formation, and wherein the conduit fluidly coupled to the fluid chamber is configured to receive the flowback fluid from the flowback conduit; and a first flow control device positioned downstream from the fluid chamber, wherein the first flow control device is configured to control a flow of the fluid exiting the fluid chamber.

2. The downhole acquisition tool of claim 1, a second flow control device positioned between an inlet of the fluid chamber and the flowback conduit, wherein the first flow control device is configured to control a flow of the flowback fluid into the fluid chamber; and wherein the piston is configured to move in response to a flow of the flowback fluid into the fluid chamber and to displace the fluid from the fluid chamber.

3. The downhole acquisition tool of claim 1, wherein the first flow control device comprises a relief valve, a choke, a choke and relief valve in parallel, or an electrically operated valve.

4. The downhole acquisition tool of claim 1, comprising a sensor disposed downstream of a fluid chamber outlet, wherein the sensor is configured to detect a property of the fluid, and wherein the property of the fluid is indicative of a horizontal stress of the formation.

5. The downhole acquisition tool of claim 4, wherein the sensor is a pressure sensor.

6. The downhole acquisition tool of claim 1, comprising an additional fluid chamber disposed downstream from and fluidly coupled to the fluid chamber, wherein the second fluid chamber is configured to receive the fluid displaced from the fluid chamber.

7. The downhole acquisition tool of claim 6, wherein the additional fluid chamber is configured to recycle the fluid back into the fluid chamber.

8. The downhole acquisition tool of claim 6, comprising a third flow control device positioned downstream of the first flow control device, wherein the third flow control device is configured to control a flow of the fluid displaced from the fluid chamber into the additional fluid chamber.

9. The downhole acquisition tool of claim 1, comprising a drain positioned along the conduit fluidly coupled to the fluid chamber adjacent to the outlet of the formation testing module, wherein the drain is configured to direct a flow of the flowback fluid in the conduit fluidly coupled to the fluid chamber to the first outlet.

10. The downhole acquisition tool of claim 1, wherein the fluid chamber comprises a first section between an inlet of the fluid chamber and the piston and a second section between the piston and a fluid chamber outlet, wherein the second section comprises the fluid and the first section is configured to receive a volume of the flowback fluid to move the piston toward the fluid chamber outlet to displace at least a portion of the fluid from the second section.

11. The downhole acquisition tool of claim 1, wherein a viscosity of the fluid is between approximately 10 centipoise (cP) and 200 cP at downhole conditions.

12. A downhole acquisition tool, comprising:

a formation testing module comprising a fluid chamber configured to store a fluid and to receive a flowback fluid, wherein the fluid is substantially free of solids;

a piston disposed within the fluid chamber;

a first conduit fluidly coupled to the fluid chamber and extending from a flowback conduit and an outlet of the formation testing module, wherein the first conduit is configured to receive the flowback fluid exiting from a fracture within a geological formation, and wherein the flowback conduit is fluidly coupled to the fracture such that the flowback conduit receives and directs the flowback fluid to the first conduit;

a first flow control device positioned between an inlet of the fluid chamber and the flowback conduit, wherein the first flow control device is configured to enable flow of the flowback fluid into the fluid chamber; and wherein the piston is configured to move toward a fluid chamber outlet to displace the fluid in response to a flow of the flowback fluid into the fluid chamber; and a sensor disposed downstream of the fluid chamber outlet, wherein the sensor is configured to detect a property of the fluid, and wherein the property of the fluid is indicative of a horizontal stress of the formation.

13. The downhole acquisition tool of claim 12, comprising a drain coupled to the first conduit and configured to direct a flow of the flowback fluid to the outlet of the formation testing module.

14. The downhole acquisition tool of claim 12, comprising an additional fluid chamber fluidly coupled to the fluid chamber via a second conduit.

15. The downhole acquisition tool of claim 14, wherein the additional fluid chamber is coupled to a check valve to facilitate recycling of the fluid into the fluid chamber.

16. The downhole acquisition tool of claim 14, wherein a choke valve is disposed along the second conduit.

17. A method, comprising;

positioning a downhole tool into a wellbore within a geological formation;

injecting a first fluid into a region of the geological formation isolated using a plurality of packers of the downhole tool, wherein the first fluid is configured to create a fracture within the isolated region of the geological formation;

determining a horizontal stress of the formation, wherein determining the minimum horizontal stress of the formation comprises:

receiving a flowback flow of the first fluid from the fracture in the geological formation, wherein the downhole tool comprises a flowback conduit fluidly coupled to the fracture and configured to receive the flowback flow of the first fluid;

directing the flowback flow to a fluid chamber disposed within a formation testing module of the downhole tool, wherein the fluid chamber comprises a piston and a second fluid, wherein the second fluid is substantially free of solids;

displacing a volume of the second fluid from the fluid chamber in response to the flowback flow of the first fluid into the fluid chamber, wherein the flowback flow is configured to move the piston in a direction toward a port of the fluid chamber and to displace the second fluid through the port; and measuring a property of the second fluid downstream of the fluid chamber using a sensor positioned along a flow path of the second fluid, wherein the property of the second fluid is representative of the horizontal stress of the formation.

18. The method of claim 17, comprising controlling a flow of the second fluid exiting the fluid chamber using a flow control device positioned between the sensor and the port of the fluid chamber such that a pressure of the second fluid is slow enough to detect a pressure decrease that is indicative of the horizontal stress of the formation.

19. The method of claim 17, comprising directing the second fluid to an additional fluid chamber disposed downstream from and fluidly coupled to the fluid chamber, wherein the additional fluid chamber is configured to recycle the second fluid to the fluid chamber.

20. The method of claim 17, comprising displacing the flowback flow of the first fluid from the fluid chamber when recycling the second fluid, wherein the second fluid is configured to flowback into the fluid chamber and to move the piston in a direction away from the port of the fluid chamber and towards an outlet of the formation testing module.

* * * * *